US006955466B1

(12) United States Patent
Söderholm

(10) Patent No.: US 6,955,466 B1
(45) Date of Patent: Oct. 18, 2005

(54) SAMPLE BAG CLOSURE DEVICE

(76) Inventor: Jan Söderholm, Luntmakargatan 71, S-113 51 Stockholm (SE)

( * ) Notice: Subject to any disclaimer, the term of this patent is extended or adjusted under 35 U.S.C. 154(b) by 19 days.

(21) Appl. No.: 10/130,600

(22) PCT Filed: Nov. 20, 2000

(86) PCT No.: PCT/SE00/02279

§ 371 (c)(1),
(2), (4) Date: Aug. 21, 2002

(87) PCT Pub. No.: WO01/38182

PCT Pub. Date: May 31, 2001

(30) Foreign Application Priority Data

Nov. 21, 1999 (SE) ..... 9904210

(51) Int. Cl.[7] ..... B65D 33/00
(52) U.S. Cl. ..... 383/205; 383/38; 383/84; 229/72; 229/309
(58) Field of Search ..... 383/205, 206, 383/38, 84; 229/309, 310, 311, 72

(56) References Cited

U.S. PATENT DOCUMENTS 3,592,380 A * 7/1971 Gerard ..... 383/205
4,946,723 A * 8/1990 Paules et al. ..... 428/43
5,054,618 A * 10/1991 Kim ..... 229/123.3
5,213,258 A * 5/1993 Kim ..... 229/305
5,683,029 A * 11/1997 Lyons ..... 229/309
6,012,844 A 1/2000 Huseman et al.
6,354,739 B1 * 3/2002 Sheehan et al. ..... 383/205

FOREIGN PATENT DOCUMENTS

| | | |
|---|---|---|
| GB | 2 066 209 A | 7/1981 |
| SE | 468 924 | 4/1993 |
| WO | 85/01272 | 3/1985 |
| WO | 89/12582 | 12/1989 |
| WO | 91/15406 | 10/1991 |
| WO | 92/16422 | 10/1992 |
| WO | 93/04946 | 3/1993 |

* cited by examiner

*Primary Examiner*—Jes F. Pascua
(74) *Attorney, Agent, or Firm*—Young & Thompson

(57) ABSTRACT

A closure device for packages having at least one self-adhesive closure element is disclosed. It comprises a self-adhesive glue layer (L1, L2) on the closure element, arranged for closing of the package. A release layer (F1, F2) covers the glue layer (L1, L2). At least one tear strip (G1, G2) is provided such that it can be torn through the package when the package is closed to form an opening. The tear strip (G1, G2) is provided on a part of the package forming the closure element, and on one side thereof that is facing inwards when the package is closed. Finally, the tear strip (G1, G2) is provided with a silicone layer on the side thereof facing the material of the package when the package is in a closed condition.

6 Claims, 2 Drawing Sheets

SAMPLE BAG CLOSURE DEVICE

BACKGROUND OF THE INVENTION

The present invention relates to a device for closing and opening a package, and a package, preferably for hazardous samples and the like.

DESCRIPTION OF THE INVENTION

From the Swedish patent 8304910-6 there is known a package primarily adapted for hazardous samples, comprising an inner compartment for receiving hazardous samples or the like, and an outer compartment enclosing the inner compartment and adapted for placing therein of a document, such as a packing slip or the like. The outer compartment has a slit-like opening adjacent the opening of the inner compartment. Both compartments can be closed with one and the same closure tab, whereby the tab closes the inner compartment in a watertight seal. The outer compartment can be opened with the aid of a tear thread, whereby the inner compartment remains closed.

Packages of this type fulfil their purpose reasonably well but suffer from the disadvantage of not being cheap enough to manufacture in order to be mass produced at a low cost. Furthermore there is a certain risk for inadvertent mix-up, namely in that the hazardous sample is not placed in the compartment adapted therefor but instead in the adjacent compartment. Furthermore, previously there has been a small but nevertheless existing risk that a sample that is soiled on its exterior, when placed in correct compartment will touch the lid tab also on the part that is adapted to close the other compartment—the document compartment—whereby there is a risk of infection at its opening.

In the Swedish patent 9102569-2 is disclosed a package the purpose of which is to prevent such risk of infection from the first compartment to the second compartment in the presence of a possibly leaking sample or sample soiled on its exterior, in particular when opening the second compartment. Furthermore there is suggested a method of manufacturing a package of this kind which allows cheap and simple mass production and which reduces the risk of mix-up between the compartment adapted for the hazardous sample or the like and the second compartment adapted for accompanying documents.

Because the first and the second tab and thereby the openings of both compartments are located on opposite sides of the package, the risk of infection is efficiently prevented when placing a sample possibly soiled on the exterior, in the first compartment and closing of the compartments, or due to leaking samples, when opening the second compartment at a later time. According to a further development the first tab is located outside both compartments of the package. Thereby this tab and the associated compartment will in a natural way be perceived by the user primarily as adapted for placing the hazardous sample therein.

This effect is amplified further if the outer contour of the second tab substantially coincides with the adjacent outer contour of the package, and thus will be perceived as a closure tab only when the first tab already has been closed, and only the second tab still is open. This will further prevent the risk that the sample is placed in the wrong compartment.

Suitably the tabs are provided with a self-adhesive glue, covered with a removable protective layer, the tabs being provided with a slit penetrating through the tab, said slit in its turn on its exterior (i.e. the side that is turned outwards when the package has been closed) is covered with a strip that can be torn off, for opening of the associated compartment. In this way it is achieved in a way known per se that the self-adhesive glue only at the correct occasion and not inadvertently will close the associated compartment, and at the same time opening of the compartments at a later time will be made easier.

It has proven to be suitable that the self-adhesive glue layer on the first glue tab, surrounds the entire associated slit, at a distance, whereby the slit or the glue layer that surrounds it, needs to be positioned accurately with respect to the opening of the compartment, which simplifies production and makes it cheaper, the compartment at the same time being closed in a liquid proof manner, and handling is simplified.

Suitably the self-adhesive layer is positioned on the side of the associated slit in the second tab closest to the outer end edge of the tab, preferably at a certain spacing. This will also make manufacture cheaper and simpler without rendering the package more difficult to handle. A the same time an additional advantage is obtained by minimizing the risk that a document that has not been pushed into the second compartment at a long enough distance inadvertently will be glued stuck when the second tab with the glue layer is fastened over the opening of the document compartment.

Suitably the side of the first compartment that is facing outwards, said compartment being adapted to be closed by the first tab, is made of shock-absorbing material. In this case it may be suitable that at one side of the second compartment, which can be closed by the second tab, also comprises or consists of shock-absorbing material. Alternatively the side facing inwards of the first compartment, said compartment being adapted to be closed by the first tab, comprises or consists of shock-absorbing material.

According to one embodiment a liquid-absorbing member is provided in the first compartment which is adapted to be closed by the first tab. Said absorbing member suitably has the shape of the sheet and is placed between the shock-absorbing layers and is fastened along one of its short sides against the inner side of the outer layer, which is possibly made of shock-absorbing material, near the opening of the document compartment such that it is impossible to position the sample between the absorbent and the outer layer. The absorbent is suitably selected to be opaque, such that it will not be possible to read text that has been applied to the sample. The liquid absorbing layer furthermore has different appearances in dry and wet or moist conditions respectively, whereby the outside of the first compartment suitably is transparent, translucent or opaque in order that it is possible to view the appearance of the liquid absorbing layer from the outside and to note changes in the case of leaking samples.

The inwards and/or outwards facing side of the second compartment, which can be closed by the second tab, can be made of a non-transparent material. The purpose of this is that unauthorised persons must not be able to read or in any other optical way perceive messages, documents or the like that has been positioned inside the second pocket without opening the package. If a package according to the invention and embodiments thereof once has been opened this will be perceivable from the outside.

With the method one obtains the advantage that the package can be mass produced in a cheap and simple way with an efficient utilization of machine time and with high accessibility. Thereby certain large tolerances can be applied regarding material and positioning, and exactness is only required in certain final operations, which simplifies manufacture and makes it cheaper and yields a price worthy product. The process can be performed continuously and efficiently by preferably unwinding the paper web and the shock-absorbing materials from rolls, and the longitudinal sides thereof are adjusted to be positioned edge to edge, which is a fairly simple operation, and also i. a. that the rolling width of the first shock-absorbing material web is selected to be about one tab width narrower than the rolling width of the paper web, but wider than the rolling width of the second shock-absorbing material web.

Suitably a liquid absorbing material is also selected to be provided in the form of rolls with a lesser width than the width of the package, it is cut transversally to be somewhat shorter than the shortest width of the shock-absorbing material, such 10 that also this material can be supplied continuously, whereby the liquid absorbing sheets after being cut, preferably are fastened with or adjacent one of the cut edges, either directly at or adjacent to the nearest edge of the second shock-absorbing material.

Also the tear strips can be supplied from rolls and provided with glue when attaching them over the slits, except for the tear strip edges, whereby gripping tabs are provided at the ends for easy removing by tearing of the tear strips.

Suitably a non-transparent paper is selected, preferably kraft paper, kraft liner or the like, which both yields strength and protection from viewing of the document or referral compartment. This paper web suitably is provided with print regarding instructions for opening, tab and compartment references, preprint of postal address and/or current information with round of the pattern corresponding to the length or width of the package.

As a shock-absorbing material suitably two plastic foils that are welded together and having enclosed there between gas or air cushions is used. Alternatively two plastic foils can be used as a shock-absorbing material, whereby a third plastic foil is provided there between and thereby forming the air cushions. The plastic foils in the layers that are to be welded together with the liquid absorbing material are suitably selected to be translucent. The shock-absorbing material located between the paper web and the liquid absorbing material need not consist of translucent material but can of course do so. One reason to select translucent plastic foils is that they commonly are the cheapest and are available as standard merchandise, which makes manufacture cheaper and thereby the end product cheaper.

A disadvantage package patented in SE-9102569-2 is that is sometimes can be difficult to open the compartment in an optimal way. Further drawbacks with this package is that it can happen that the liquid sample that leaks out of its package, can penetrate through the slit that has been provided in the kraft liner that the package has been made from. The liquid sealing PE-layer has been cut through, and trials have shown that there is a risk that liquids penetrate out through the closure, albeit after relatively long time, i.e. some or few days. However, this can in certain cases be unacceptable.

SUMMARY OF THE INVENTION

The present invention therefore seeks to improve the opening function in a package of the type disclosed in SE-9102569-2.

This is achieved by a package device having self-adhesive closure means, by a closure device having a tear function and which is disclosed below.

Thereby the through slit used in the known package has been eliminated, and the tear strip has been provided on the inside of the tab instead of on the outside thereof. In a preferred embodiment the tear strip, on its outside, i.e. the side that is not fastened against the tab, is provided with a layer of silicone. Thereby the glue layer that is applied on the tab, and which is to achieve that the tab does not stick at closing, will not adhere appreciably to the tab over the better part thereof. Neither will the tear strip be able to participate in welding for the case where the tear strip is present between two PE-layers that are to be joined, i.e. at an edge weld of a package. Thereby a channel or "tunnel" is formed to be in the siliconized surface of the tear strip and the glue layer, or between the siliconized surface of the tear strip and PE-layer in the side weld. When the tab is glued against the package at the time of closing, the tear strip will therefore adhere poorer against that part of the package against which said glue layer is applied on closing, which makes it very easy to tear the strip through the paper tab, and in this way achieve opening. However, the closure device has a general applicability, and the illustrated use with the previously known bag package is only one possibility.

BRIEF DESCRIPTION OF THE DRAWINGS

By the new invention there is provided a device that enables liquid tight transportation of hazardous samples, and which is tamper proof, i.e. that non-authorized access of the interior of the package cannot happen without it being discovered. The invention will now be described in more detail with reference to an embodiment of a package of the type referred to above, having a closure and opening means according to the invention.

DESCRIPTION OF THE PREFERRED EMBODIMENTS

Figure 1:
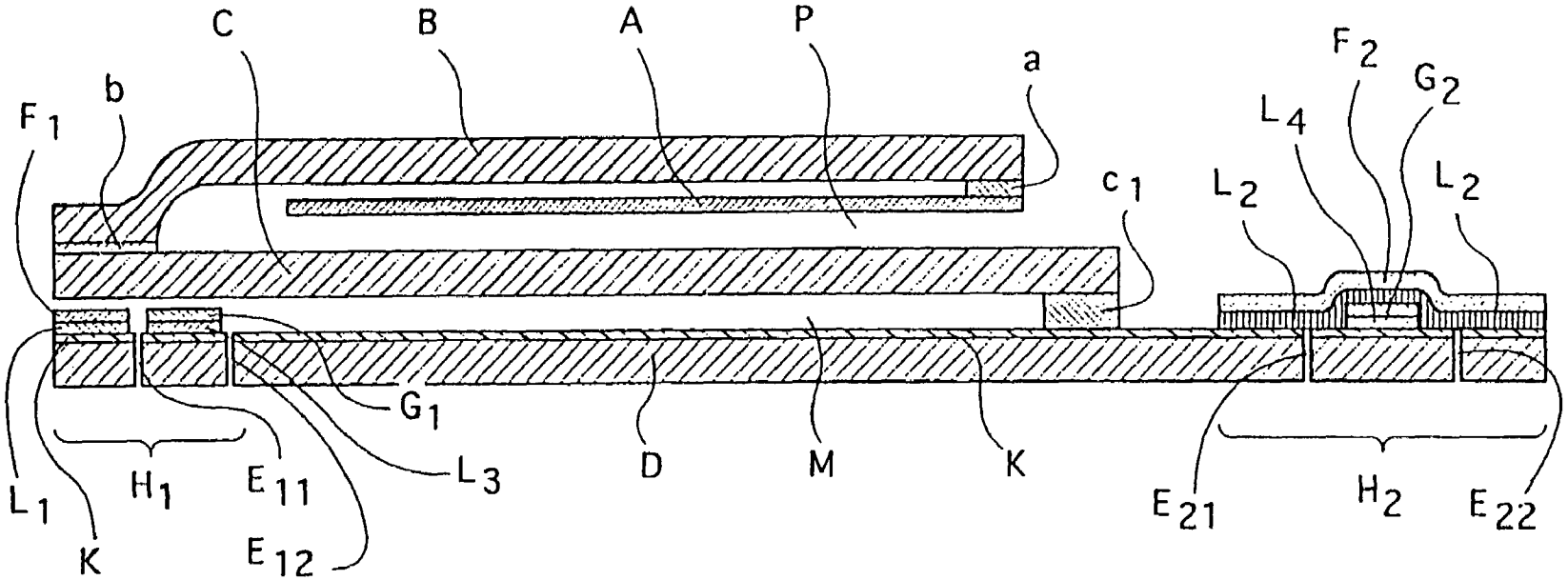
FIG. 1 shows a cross section through a package having a closure and opening means according to the invention.

As can be seen of the schematic cross section view according to FIG. 1 the illustrated embodiment of the package consists of a first compartment P, adapted for the sample in question, and which is closable with a first tab H2, and a second compartment M, adapted as a document or admission note compartment which is closable with the second tab H1. As clearly can be seen in FIG. 1 the first tab H2 and the second tab H1 as well as the opening of the first compartment P and the opening of the second compartment M are located on opposite sides of the package. In the first compartment P which is closable with the first tab H2, there is provided a liquid absorber A, which at its right end edge (viewed in the figure) is fastened quite close to the opening of the compartment P. A sample R positioned in the compartment P is thus not visible, and due to the non-transparency of the absorber A it is not possible to read what may be written on the sample either.

Figure 2:
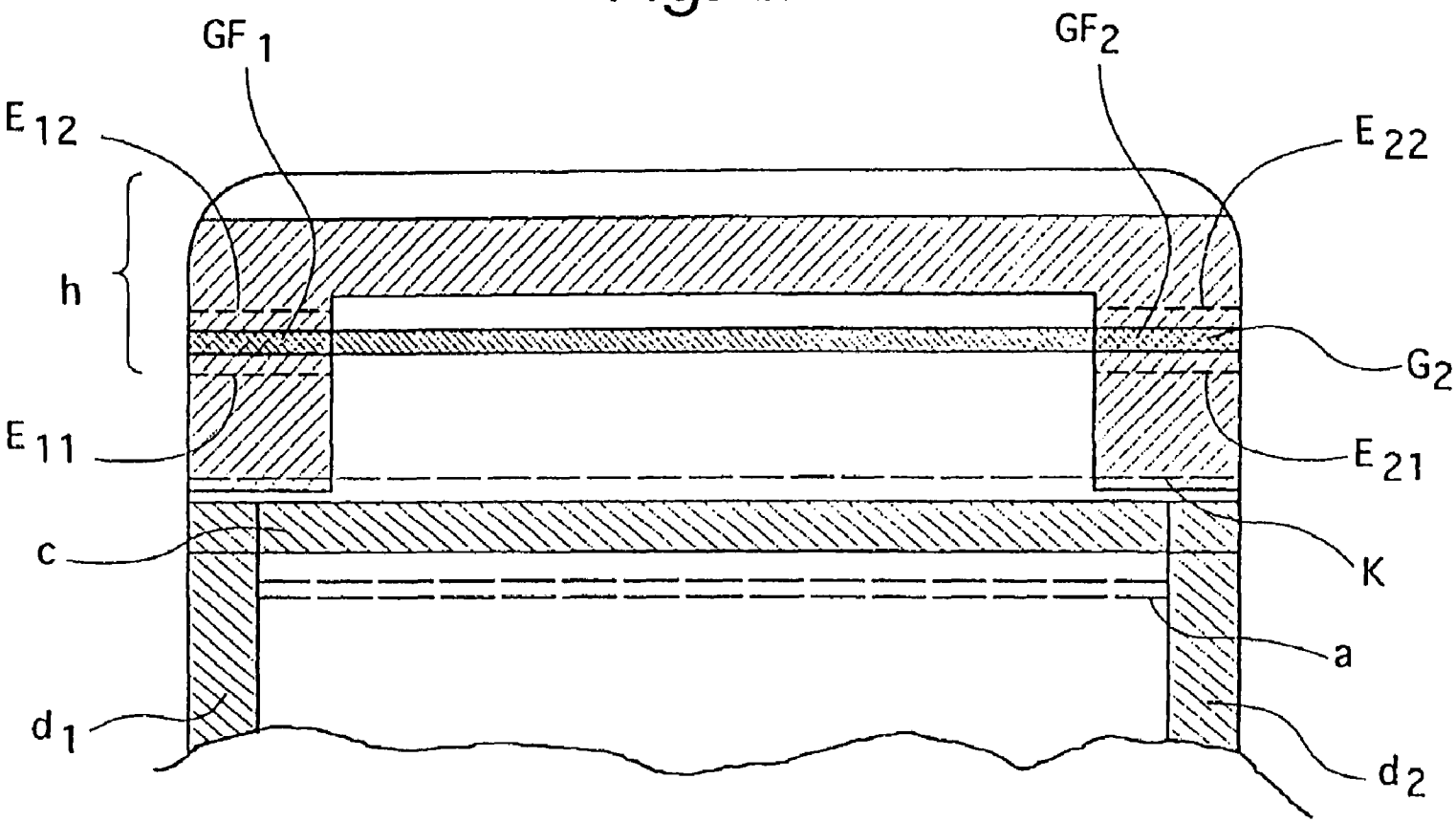
FIG. 2 shows a view from above one end of the package having the protruding tab.

Furthermore, as is evident from FIGS. 1 and 2 the tab H2, which is adapted for closing the sample compartment P in its unclosed condition, is positioned outside both compartments of the package. The tab H1 of the admission note or document compartment, however, has an outer contour which substantially coincide with the adjacent outer contour of the package. Both tabs H1 and H2 are provided with one layer each of self-adhesive glue L1 and L2, covered with one releasable protective layer F1, F2 each, these also being referred to as release layers. These protective layers preferably consist of silicone treated foil material, e.g. silicone treated paper.

The upper restricting wall B of the sample compartment P in FIG. 1 e.g. comprises a double layer bubble foil made of polyethylene, having dimensions 250×200 mm (roll width 200 mm). The absorption layer that is attached at a thereby can have dimensions 230×270 mm (roll width 270 mm). The absorber is attached along one or both of its short edges against the double layer bubble foil. It is of importance that the absorber in its left end (as viewed in FIG. 1) does not extend too close to the left end of the layer B, such that there will be room for welding together of layer B with the layer C which is located there underneath, said layer C e.g. can be comprised of a three layer bubble foil of polyethylene, possibly having the dimensions 270×200 mm (roll width 270 mm). Beneath these both layers there is a layer D of polyethylene coated kraft liner, in the present case having the dimension 320×200 mm (roll width 320 mm).

The shock-absorbing layer C has been welded together with the kraft liner D in the weld $c_1$ quite adjacent the opening edge of the sample compartment P. In addition to layers C and D are also welded together by means of the longitudinally running welds $d_1$ and $d_2$.

The shock-absorbing layer B should be transparent in order to enable the observation of changes in the appearance of the liquid absorbing material A in the case of a leaking sample. The second shock-absorbing layer C can but does not necessarily need to be transparent, translucent or opaque. The layer D which is provided with the tabs should normally not be translucent or transparent, in any case if one wishes that the content of the document pocket M should not be possible to read from the outside. The material for the layer D is selected among known materials having regard to the properties one wishes that the layer D should have. For example the layer D could be shock-absorbing and the layer C could be non-shock-absorbing.

Practical trials with prototypes have shown that it is very easy to close both compartments of the package and also to open them separately.

In accordance with the invention each tab, H1, H2 is provided on the inside, i.e. the side that lies close to the bag when it has been closed, are provided with a self-adhesive tear strip (or tear tape) $G_1$, $G_2$ running in the transverse direction, transversely over respective tab. This tear tape thus is applied on the PE-layer K of the kraft liner D, such that it attaches against the PE-layer with its glue. The tear tape $G_1$, $G_2$ is a self-adhesive tape, e.g. consisting of a polypropylene carrier coated with an adhesive compound $L_3$, $L_4$ and provided with a release layer of silicone. Alternatively it can be a self-adhesive tear tape having a monoaxially polypropylene coated with polyethylene and adhesive compound, and provided with a release layer of silicone. These tapes can be obtained from Beiersdorf, Germany under the trade names Tesa 4235 and Tesa 51235 respectively.

After the tear tape has been attached to the PE-layer according to the above disclosure, a glue layer is applied on an area around and over the strip, thereby forming a closure means, such as a tab, that can be folded over an opening and thereby close the package. This glue layer $L_1$, $L_2$ will due to the siliconized surface of the tear strip not adhere against the tear tape to any particular degree. However the adhesion is enough to achieve that the strip is held in place. The release paper or protective foil $F_1$, $F_2$ is applied over the glue layer $L_1$, $L_2$ and over the tear strip.

Due to the lesser degree of adhesion between tear strip and glue layer $L_1$, $L_2$, there is formed a "tunnel" between the tab and the tear strip. This "tunnel" does not have any proper volume, but is rather to be looked upon as an area where the two materials have a capability of being easily separated.

This can be most clearly seen if one touches the glue layer with a finger where the layer in question lies over the tear strip. Since the glue is a very strongly tacky glue, it will immediately stick to the finger. If it then is attempted to remove the finger therefrom, the glue will be lifted from the tear strip and form a blister because it is tough and does not adhere against the tear strip. When the tab has been attached to the package material at the time of closing, this effect will facilitate tearing of the strip through the tab. The tear strip simply releases easier from the package material against which the tab has been glued on closing the package. Possibly it can be required to apply slightly more silicone than what is present on the commercially available tape in order to achieve optimal function.

The tear tape strip $G_1$ on the smaller of the tabs $H_1$ is provided such that it will be located within the region where the bag is edgewelded in its longitudinal direction. However it will not participate in the weld because of the silicone layer. Thereby an advantage is achieved the same way as with the other tab, in that it becomes easier to separate the layers and thereby get a grip of the end of the tape in order to tear it through the paper of the closure tab $H_1$.

It is also possible to use a glue of the same type as for the glue layers $L_1$, $L_2$ instead of welding the side edges, at $d_1$, and $d_2$, of the package together. Thereby one achieves the same effect as with the first embodiment disclosed above, where the tear strip is located on a closure tab, and is covered by a glue layer that does not adhere against the silicone to any significant degree.

In order to improve function further it is possible according to the invention to provide edge cuttings $E_{11}$, $E_{12}$ at the strip $G_1$, and $E_{21}$, $E_{22}$ at the strip $G_2$. These edge cuttings are made on either side of the ends of the tapes, and a small distance into the edge area of the bag. Thereby gripping tabs GF are formed, making it easier to get a grip on the tear strip thereby making it easy to open the package. This is most clearly evident from FIG. 2. Such edge cuttings are suitably made by two parallel knives or industrial blades provided in the manufacturing line. Another way of achieving the edge cutting is by punching. Punching can be preferable in that it is possible to shape the gripping tabs according to desire, e.g. by making cuttings wider, and the gripping tabs can be given a rounded shape in order to make them grip friendlier. A skilled man will easily realise how such an operation is implemented in a plant.

What is claimed is:

1. A package, comprising:

a first compartment (P), which can be closed by a first tab ($H_2$); and a second compartment (M) which can be closed with a second ta ($H_1$);

whereby the tabs ($H_1$, $H_2$) are provided with one layer each of self-adhesive glue ($L_1$, $L_2$) covered by a removable protective layer ($F_1$, $F_2$) of foil material, applied over the glue ($L_1$, $L_2$)

wherein the first and the second tabs as well as the opening of the first compartment and the opening of the second compartment are located at opposite edges of the package, and wherein the side (C) of the first compartment (P) which can be closed by the first tab ($H_2$) said side facing outwards, comprises a shock-absorbing material, and at least one tear strip ($G_1$, $G_2$), arranged on at least one of the tabs ($H_1$, $H_2$), wherein the tear strip ($G_1$, $G_2$) is coated with an adhesive compound ($L_3$, $L_4$) and is provided with a release layer of silicone on the side thereof that faces the material of the package in the closed condition of the package.

2. The package according to claim 1, wherein the self-adhesive glue layer ($L_1$, $L_2$) covers the tear strip at least partly, the release layer ($F_1$, $F_2$) covers the tear strip ($G_1$, $G_2$) and the glue layer ($L_1$, $L_2$), and wherein there is an area along the major part of the length of the tear strip that has poorer adhesiveness against the glue in the layer ($L_1$, $L_2$) than the material of the package has.

3. The package according to claim 1, comprising edge cuttings ($E_{11}$, $E_{12}$, $E_{21}$, $E_{22}$) on at least one of the tabs ($H_1$, $H_2$) on both sides of the associated tear strip ($G_1$, $G_2$) so as to form a respective gripping tab ($GF_1$, $GF_2$).

4. The package according to claim 1, wherein the tear strip (G2) is provided on a closure tab (H2) of the package, wherein the glue layer (L2) covers at least end portions of the tear strip.

5. The package according to claim 1, wherein the tear strip (Gi) is provided such that its end portions are located in an edge weld between two polyethylene layers, whereby the silicone layer renders the adhesion between a silicone surface of the tear strip and one of the polyethylene layers so low that it is possible without difficulty to separate the tear strip from the polyethylene layer in the weld.

6. The package according to claim 1, wherein the tear strip (Gi) is provided such that its end portions are provided in the glue joint of the package between two glue layers, whereby the silicone layer renders the adhesion between a silicone surface of the tear strip and one of the glue layers so low that it is possible without difficulty co separate the tear strip from the glue layer of the joint.

* * * * *